US008267195B1

(12) United States Patent
Scruggs

(10) Patent No.: US 8,267,195 B1
(45) Date of Patent: Sep. 18, 2012

(54) GRAVE SITE THAWING, SOFTENING AND BORING APPARATUS FOR VERTICAL BURIAL CONTAINERS IN FROZEN GROUND

(76) Inventor: Donald E. Scruggs, Chino, CA (US)

( * ) Notice: Subject to any disclaimer, the term of this patent is extended or adjusted under 35 U.S.C. 154(b) by 58 days.

(21) Appl. No.: 13/136,050

(22) Filed: Jul. 21, 2011

(51) Int. Cl.
*E21B 7/18* (2006.01)

(52) U.S. Cl. ..... 175/11; 175/17

(58) Field of Classification Search ..... 175/11, 175/17, 66; 166/57, 302; 126/19.5, 271.1, 126/357.1; 37/227
See application file for complete search history.

(56) References Cited

U.S. PATENT DOCUMENTS

| | | | | | |
|---|---|---|---|---|---|
| 607,229 | A * | 7/1898 | Dyer | 175/17 |
| 1,881,176 | A * | 10/1932 | Epley | 175/17 |
| 3,055,647 | A * | 9/1962 | Morrison et al. | 299/19 |
| 3,404,731 | A * | 10/1968 | Cushman | 165/51 |
| 3,470,968 | A * | 10/1969 | Melsheimer et al. | 173/24 |
| 3,868,825 | A | 3/1975 | Boyce | |
| 3,990,502 | A | 11/1976 | Best | |
| 4,027,631 | A * | 6/1977 | Lavery | 122/26 |
| 4,215,753 | A * | 8/1980 | Champness | 175/17 |
| 4,349,010 | A | 9/1982 | Bentham | |
| 5,033,452 | A | 7/1991 | Carriere | |
| 5,441,038 | A | 8/1995 | Ohmann | |
| 5,469,598 | A * | 11/1995 | Sales | 15/321 |
| 6,126,081 | A | 10/2000 | Calvin et al. | |
| 6,408,843 | B1 | 6/2002 | Olson | |
| 6,779,606 | B1 * | 8/2004 | Lopez | 166/303 |
| 7,037,105 | B2 * | 5/2006 | Hayes | 432/63 |
| 7,424,916 | B2 * | 9/2008 | Foster et al. | 166/303 |
| 2003/0116354 | A1 * | 6/2003 | Yamashita | 175/17 |

* cited by examiner

*Primary Examiner* — Jennifer H Gay
*Assistant Examiner* — Blake Michener

(57) ABSTRACT

An apparatus to thaw, soften and bore a pilot hole into frozen ground for the interment of screw-in, self digging and other vertical burial containers by pumping water heated by scavenging heat from different elements of a fuel burning engine, plus the heat generated by a hydraulic power transfer system and the heat generated by a fuel burning combustion chamber and having load increasing devices on the fuel engine and hydraulic power transfer system to further increase heat.

1 Claim, 5 Drawing Sheets

GRAVE SITE THAWING, SOFTENING AND BORING APPARATUS FOR VERTICAL BURIAL CONTAINERS IN FROZEN GROUND

CROSS REFERENCE TO RELATED APPLICATIONS

None

FEDERALLY SPONSORED RESEARCH

None

PARTIES TO JOINT RESEARCH

None

BACKGROUND OF THE INVENTION

For about one third of the year, the ground in about one fourth of the United States is frozen to where it is difficult to dig a large horizontal grave site and extremely difficult to inter a screw-in, self digging or other non-horizontal burial container needing a small cross section space. The earth or ground displacement equipment commonly used to break through the upper layer of frozen soil for a large horizontal grave site experiences trouble in digging a small cross section hole for a vertical coffin interment. Most cemeteries in these colder areas have heavy enough equipment to break up the frozen ground and dig the large, usually four feet wide by seven feet deep by seven to eight feet long hole required for a horizontal burial. Naturally, this increases the already higher costs of horizontal burial over vertical burial.

Screw-in coffins are tapered from the head end to the foot end and have screw threads spiraling around the hull. They are set vertically against the ground, sometimes in a pilot hole, rotated and literally screw into the ground. Self digging and self boring coffins which have cutting elements on their lower edges, are set against the ground and rotated to cut into the ground. These types require about a three foot diameter space in softer less frozen ground. Even with a fairly large pilot hole a screw-in coffin must be rotated back and forth to work it through frozen ground. Once a person has passed away, friends and relatives want them interred as soon as possible. Such action is usually needed to provide closure to those friends and relatives. If the friends and relatives have elected to inter the deceased in a much more environmentally friendly and economical space saving way, a screw-in or self digging coffin is needed.

In winter-frozen ground areas the present invention is the simplest and easiest way to prepare the ground for such an interment. With this invention, the frozen ground is both thawed and softened, making a screw-in, self boring or self digging coffin interment ideal.

FIELD OF THE INVENTION

This invention relates to the thawing of frozen ground for non-horizontal burial container interments, especially those interments using screw-in and self digging burial containers.

RELATED ART

There are a number of types of equipment for putting steam down deep oil wells to extract oil from shale and tar deposits. These types are usually large and heavy duty and often burn crude oil under boilers to create the needed high volume and high pressure steam. In almost all cases they put the steam thousands of feet below ground level. No apparatus is found that routes heat to thaw frozen ground at or very near to ground level from the fuel engine heat normally dissipated by a radiator and the fuel engine exhaust gas heat normally routed overboard nor the heat generated by a hydraulic power system. Also, no apparatus is found that incorporates the increasing of the load on a fuel engine to increase its heat output nor have any been found that further increase engine heat and hydraulic system heat by intentionally restricting the flow of hydraulic fluids to increase pressure and heat and transfers that engine and hydraulic heat to another fluid to be used in a thawing operation.

SUMMARY OF THE INVENTION

This invention provides cemeteries in areas where the ground freeze in winter with a simple and easy way to thaw the ground for the interment of non-horizontal burials. It is an apparatus consisting of a number of insulated components that transfer heat to a working-water or working-fluid in a well insulated tank. The apparatus is made up of a commonly available fuel burning engine, a radiator and an engage-disengage clutch assembly supplying power to commonly available hydraulic pumps driving various hydraulic motors moving a working-fluid to and from a ground area to be thawed and fluid-bored. Diverter valves are used to route the engine coolant away from the standard radiator and to a radiator in contact with the working fluid, passing the coolant heat to the working-fluid, while the hydraulic fluid in the hydraulic power system is made to be in contact with the same working-fluid to pass the heat in the hydraulic system to the working-fluid and common choke valves in the lines of the hydraulic system are used to restrict the flow of hydraulic fluid to increase the pressure and heat in that system and induce additional load on the fuel burning engine, thus increasing its heat output. The entire apparatus is mounted on a framework of commonly fabricated parts using common metal forming and welding techniques.

The invented apparatus is operated by filling an insulated tank with a working-fluid, such as water or water with additives such as detergents and or fertilizers, setting the output end of a working-fluid boring device onto frozen ground and starting a fuel burning engine and engaging a hydraulic system. The heat produced by the engine and the hydraulic system is transferred to the working-fluid in the insulated tank.

When the heated working-fluid in the insulated tank is pumped down a working-fluid boring device and made to contact frozen ground, the ground thaws and dilutes into silt and mud and a small diameter pilot hole is fluid-bored down through the frozen ground. The working-fluid containing silt and mud is pumped back up to the insulated working-fluid tank where much of the silt and mud is deposited and subsequently removed from the bottom of the tank by way of a common rotary valve. The remainder of the silt laden working-fluid is reheated and returned down a conduit of the working-fluid boring device to a stirring fixture to thaw and soften additional ground and increase the depth of the pilot hole. As the stirring fixture works its way downward, heat from the working-fluid being pumped downward radiates out into the surrounding ground, thawing and softening it. Where the stirring fixture is distributing the heated working-fluid, a thawed and softened pilot hole is being created, into which can be interred a screw-in or self digging coffin.

The invented apparatus provides power for the movement of the working-fluid by burning fuel in a conventional engine and in doing so produces heat within the cooling fluid of the engine and in the engine exhaust gas piping. Common diverter valves route the cooling fluid of the engine away from the regular radiator of the engine and circulate it through a first radiator within an insulated working-fluid tank. The engine exhaust gas piping is surrounded by an enclosure containing fluid which absorbs heat from the exhaust gases and transfers that heat to the working-fluid through a second radiator in the insulated working-fluid tank.

The fuel engine of the apparatus drives a hydraulic pump which provides power to a first hydraulic motor for moving the fluid in the engine cooling system and the engine exhaust gas heat transfer fluid through the insulated working-fluid tank. The said hydraulic pump provides power through a second hydraulic motor to move silted working-fluid out from the insulated working-fluid tank to the ground to be thawed. The said hydraulic pump also provides power to a third hydraulic motor to move the silted and muddied working-fluid back up to the said working-fluid tank. The said hydraulic pump supplies power to a fourth hydraulic motor driving a rotary valve at the lowest point of the said working-fluid tank to remove mud and silt from the tank. The said hydraulic pump provides power to a fifth hydraulic motor moving a chain drive to gradually move the working-fluid boring device downward with its heated working-fluid, continually thawing and fluid-boring a pilot hole.

As the engine load is increased in the engine supplying power to the hydraulic and fluid pumps in the apparatus, the engine and exhaust gas heat rises. Thus more heat is routed away from the regular radiator of the engine, by way of common director valves, and through a radiator in the said working-fluid tank of the apparatus and the added heat in the engine exhaust gases is also transferred to a radiator in the working-fluid tank.

The hydraulic pump and hydraulic motors within the apparatus are variably restricted by common choke valves to increase pressure and thus increase heat in the hydraulic system. That heat is transferred to the working-fluid through a radiator in the working-fluid tank.

Making a pilot hole in near permafrost ground by recycling fluid warmed by the transfer of heat from a fuel engine's coolant and exhaust gases, plus the heat produced by the workings of a hydraulic power system and inducing added heat in these systems by restricting the flow in the hydraulic system by common choke valves to increase pressure and heat is new and novel.

It is known that a certain amount of silt and mud will be brought back up and into the working-fluid tank. A sealed, motor driven rotary valve mechanism is incorporated across the bottom edge of the sloped bottom of the working-fluid tank to provide for removal of silt and mud which accumulates at the lowest point of the working-fluid tank.

The elements of the apparatus can be fitted onto an existing tractor, backhoe or other such vehicle to scavenge heat from the fuel engine cooling system, the exhaust gases of the vehicle and the hydraulic power supply of the vehicle. This arrangement must include a separate insulated working-fluid tank where the scavenged heat from the vehicle is routed by way of external hoses to transfer heat, through radiators, to the working-fluid in the insulated working-fluid tank which is to be pumped onto and into the ground intended to be thawed.

The elements of the apparatus, including a fuel burning engine are ideally installed onto a trailer, a skid or other independent vehicle having a boom-arm arrangement on which the powered, chain driven, guide rail and heated working-fluid pilot hole boring device is fitted. The trailer can be set into place with the engine running and the heated working-fluid pilot hole boring device on a chain driven platform, on a guiding rack will thaw the frozen ground, remove the mud and silt and develop a softened pilot hole.

A screw-in or self digging coffin can then be interred by way of the pilot hole. The trailer can also be made to handle a turning and swiveling head to operate a "POSITIONING AND ROTATING APPARATUS FOR INTERRING SCREW-IN AND SELF DIGGING BURIAL CONTAINERS" such as disclosed in USPTO application Ser. No. 12/556,991.

DESCRIPTION OF THE PREFERRED EMBODIMENT

The invented apparatus is made up of a commonly available fuel burning engine driving one or more commonly available hydraulic pumps supplying power to a number of commonly available hydraulic motors turning pumps to move a working-fluid, heated by the fuel burning engine and heat generated in the hydraulic system and transferred into a working-fluid which is moved into and out of an insulated tank where some of the silt is removed and cycled into and out of a hole in frozen ground to both thaw the ground and fluid bore a hole, with all the equipment mounted on or adjacent to framework produced by common metalworking processes.

Figure 1:
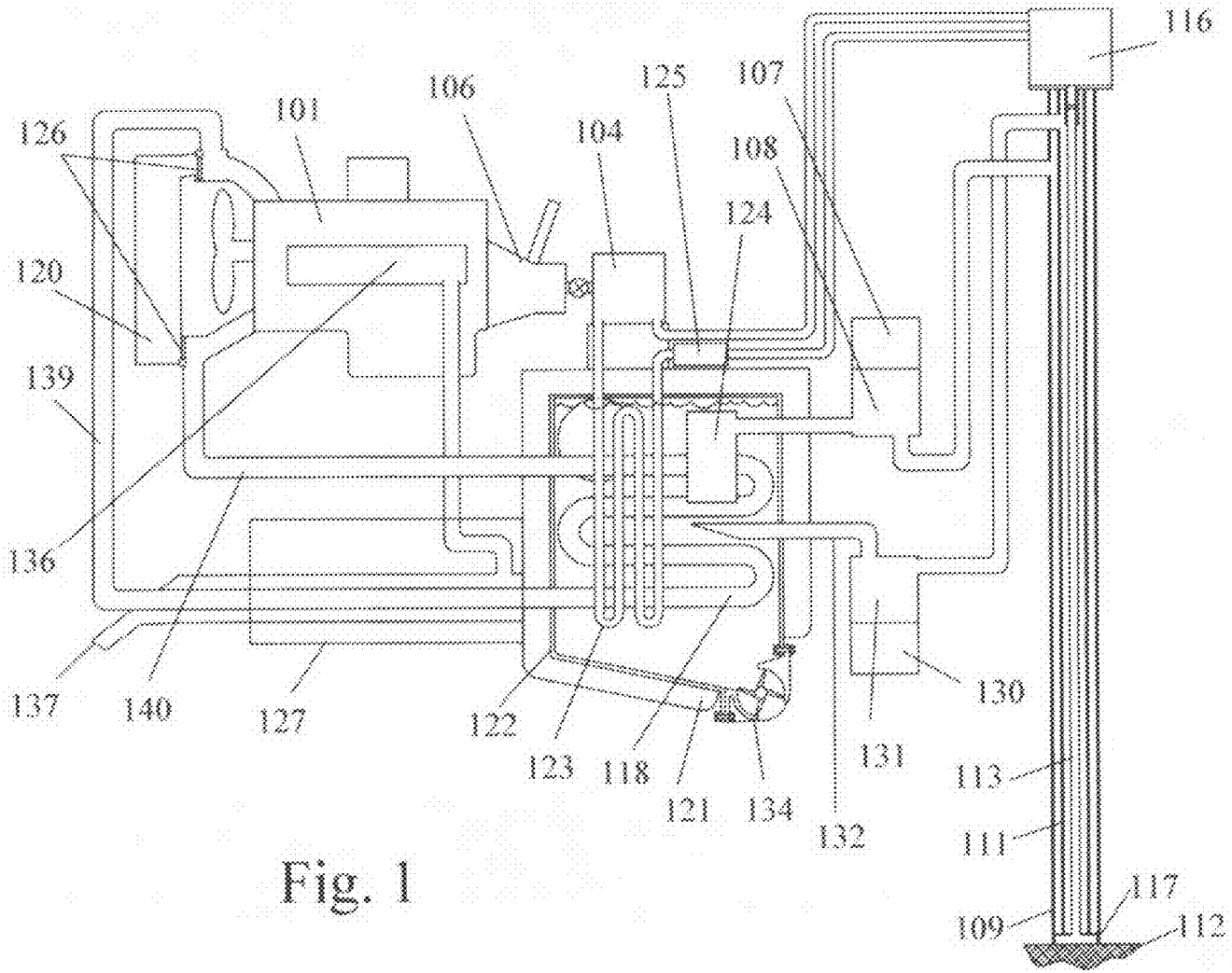
FIG. 1 is an overall schematic of the invented apparatus.

FIG. 1 is a system schematic of the invention showing a fuel engine, 101, driving a hydraulic pump, 104, by way of an engageable clutch, 106, to supply power to a first hydraulic motor, 107, which drives a first fluid pump, 108, drawing heated working-fluid from an insulated working-fluid tank, 122, through a filter, 124, and sending it down to where frozen ground, 112, is to be thawed. As the heated working-fluid flows downward through a first conduit, formed by the space between a first outside casing, 109, and a second inside casing, 111, some of its heat radiates out through the outside casing, 109, to the surrounding ground, warming and thawing it. A shaft, 113, driven by a second hydraulic motor, 116, turns a stirring fixture, 117, at the bottom of a working-fluid boring device formed by the first and second casings and the stirring fixture. Coolant director valves, 126, shut off the flow of fluid to the first radiator, 120, regularly cooling the engine and route the fluid through a second radiator, 118, inside a working-fluid tank, 122, enclosed in insulation 121. Work heated hydraulic fluid from the hydraulic pump, 104, variably restricted by a choke valve, 125, is routed through a third radiator, 123, in the same working-fluid tank. A third hydraulic motor, 130, drives a third working-fluid pump, 131, which pulls now cooled silt and mud laden working-fluid up from the low end of the second conduit formed by the inside second casing and the stirring fixture shaft, 113, and feeds it back through a return pipe, 132, into the working-fluid tank, 122. A rotary valve, 134, driven by a fourth hydraulic motor (not shown) removes the mud and silt accumulating at the bottom of the working-fluid tank. The rotary valve housing is removed to completely access the working-fluid tank. An enclosed engine exhaust manifold, 136, routes the heat of the engine exhaust gases to an insulated housing, 127, where the heat is transferred to the engine fluid, 139, which is routed through a second radiator, 118, in the working-fluid tank and returned by pipe, 140. The cooled exhaust gases exit out a pipe, 137.

Figure 2:
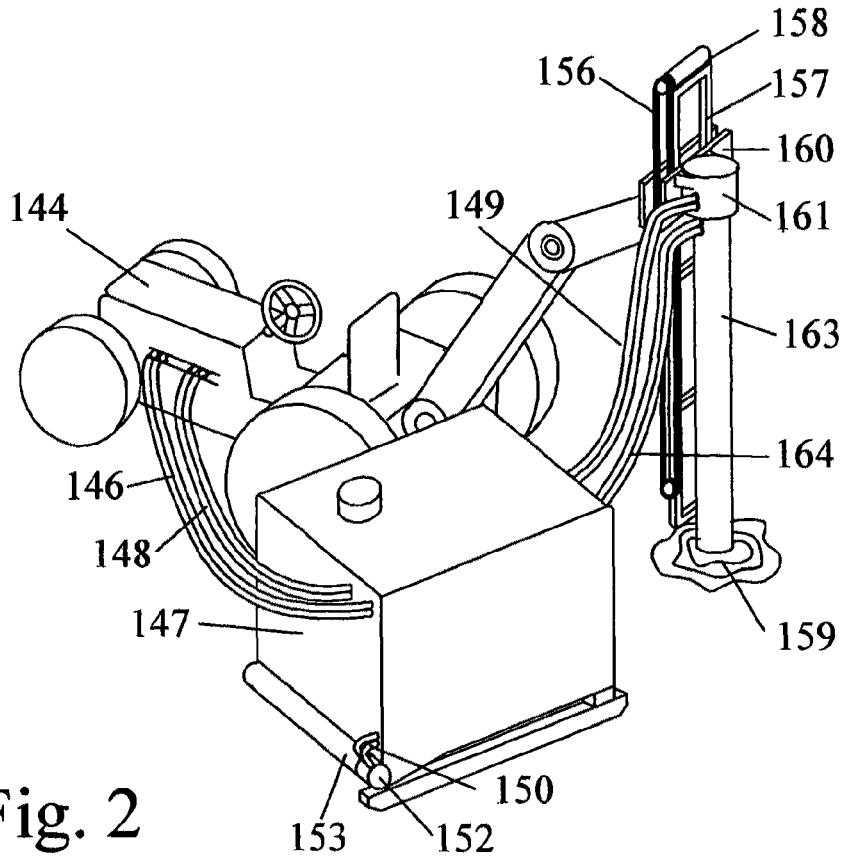
FIG. 2 is an orthographic view of the apparatus adapted to a tractor-backhoe vehicle with a skid mounted working-fluid tank, and with a working-fluid boring device, having a downward working-fluid conduit and a separate upward working-fluid conduit and a powered stirring fixture, making a thawed and softened pilot hole.

FIG. 2, is an orthographic view of a tractor-backhoe, 144, fitted with the elements of the subject invention, showing fluid hoses, 146, from the cooling system of the engine of the tractor-backhoe feeding heated fluid into a radiator, not shown, inside of a skid mounted working-fluid tank, 147, and hydraulic hoses, 148, feeding heated hydraulic fluid into a radiator, (not shown, see FIG. 1, item 123) in the working-fluid tank, 147, and exiting out the other side, 149, to feed hydraulic power to a second hydraulic motor, 161, which turns a shaft running through the center of a working-fluid boring device, 163, with the hydraulic motor, 161, mounted on a platform, 160, mounted to slide on a guide rack, 157, having a chain drive, 156, powered by a hydraulic motor, 158, moving the platform downward as the working-fluid boring device thaws the ground and creates a softened pilot hole, 159. Item 164, is hosing supplying heated working-fluid to the working-fluid boring device and returning it to the working-fluid tank. Hydraulic lines, 150, supply power to a hydraulic motor, 152, which drives a rotary valve, 153, to remove silt and mud from the working-fluid tank, 147.

Figure 3:
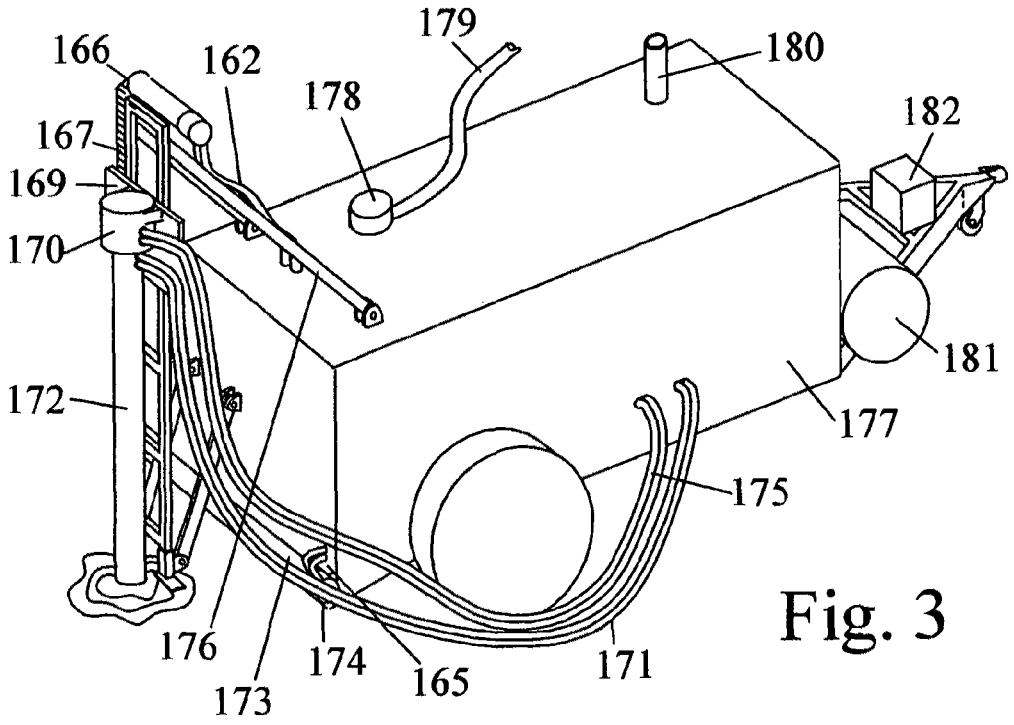
FIG. 3 is an orthographic view of the invented apparatus mounted on a trailer having a fuel engine, fluid tank and other elements inside, not visible, and its guide rail and working-fluid boring device making a thawed and softened pilot hole outside.

FIG. 3 is an orthographic drawing of the invention mounted on a trailer having a fuel engine inside an enclosure, 177, with fluid hoses from the cooling system of the engine feeding heated fluid into a radiator inside a working-fluid tank, (not shown, See item 122, FIG. 1.) Hydraulic hoses, 171, have fed work heated hydraulic fluid through a radiator in the working-fluid tank, (not shown, see item 122, FIG. 1. Hydraulic lines, 175, exit out the enclosure and feed hydraulic power to a hydraulic motor, 170, which drives a shaft with a stirring fixture, not visible, see item 117, FIG. 1, at the bottom of a working-fluid boring device, 172. Another hydraulic line, 165, provides power to a hydraulic motor, 174, to turn a rotary valve, 173, removing the mud and silt accumulating at the bottom of the working-fluid tank. And yet another hydraulic line, 162, provides power to a hydraulic motor, 166, to drive a chain mechanism, 167, which moves a platform, 169, up and down. The motor driven chain mechanism attached to this platform, 169, on which is mounted a hydraulic motor, 170, keeps the working-fluid boring device, 172, moving downward as the ground is thawed and softened. The silt and mud laden working-fluid is pulled up from the low end of the inside conduit, see item 111, FIG. 1, and fed back into the working-fluid tank by way of a hose, 175. Also shown are the guide rack bracing arms, 176, a fluid fill, 178, a fluid fill hose, 179, an engine exhaust outlet, 180, a fuel tank, 181, and a battery, 182.

Figure 4:
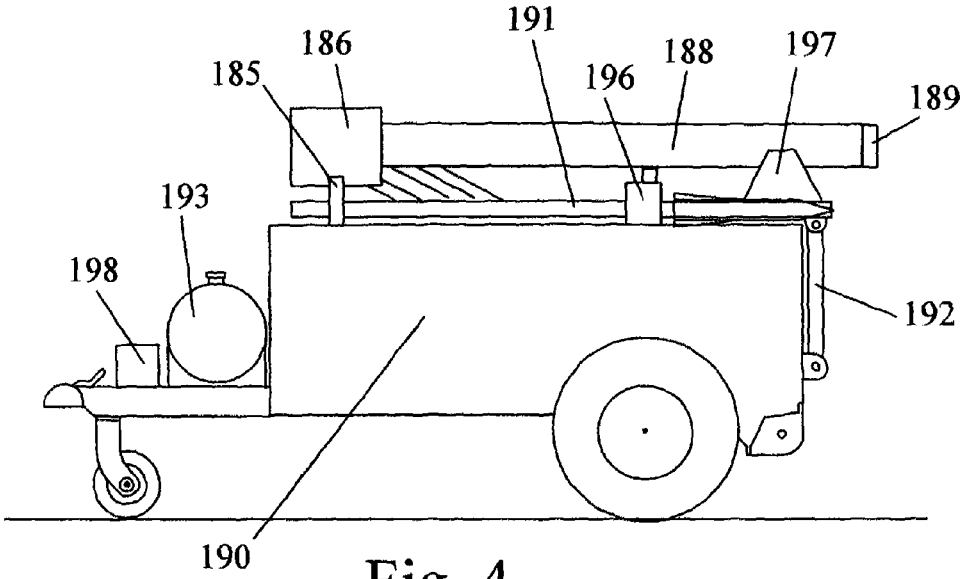
FIG. 4 is a side view of the invented apparatus mounted on a trailer with its external equipment stored on top of the trailer.

FIG. 4 is a side view of a trailer with an enclosure, 190, holding elements of the invention packed for travel, and showing a working-fluid boring device, 188, with a hydraulic motor, 186, to drive a shaft to rotate a stirring fixture, 189, resting on a support bracket, 185, a guide rack, 191, and bracing arms, 192, folded up on the top and back of the trailer. Also shown is a fuel tank, 193, a fluid fill, 196, a prop and holder, 197, and a battery, 198. The necessary fluid and hydraulic hoses are stored on the sides of the enclosure.

Figure 5:
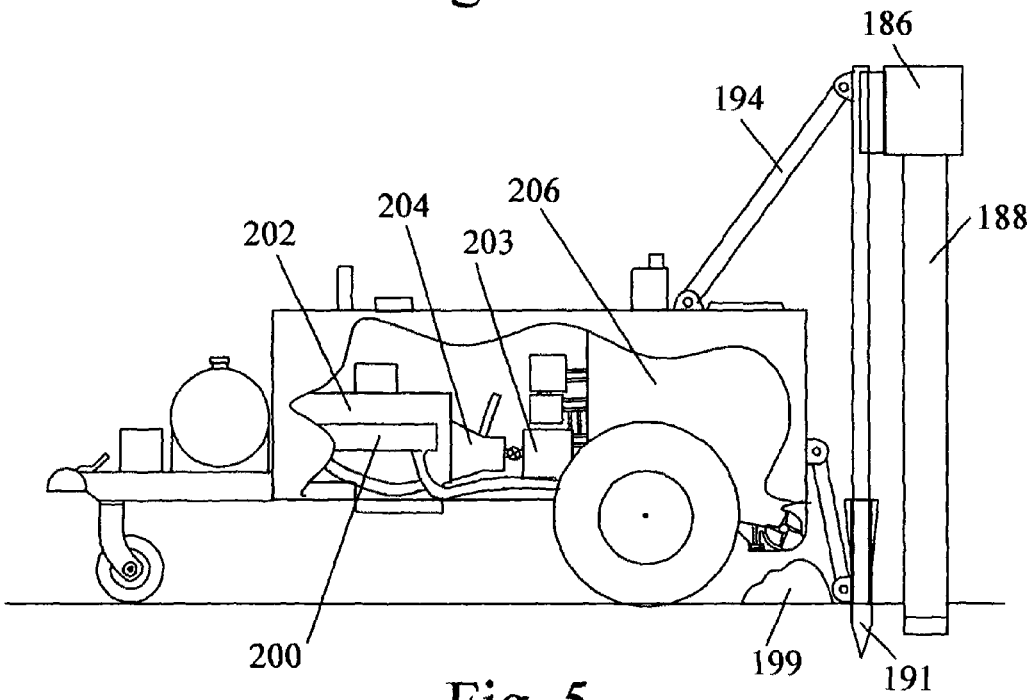
FIG. 5 is a partially cutaway side view of the invented apparatus mounted on a trailer with its external equipment folded out from the trailer in operating position.

FIG. 5 is a side view of a trailer in working position, with its enclosure, 206, cut away to show the various elements of the invention. Reference FIGS. 1 and 3. The enclosure is insulated to retain heat for ultimate transfer to the ground surrounding the working-fluid boring device. This Figure shows a fuel engine, 202, driving a hydraulic pump, 203, through an engage-disengage clutch, 204, to supply power to several hydraulic motors. The first motor drives a pump drawing heated working-fluid from a working-fluid tank, 206, through a filter and sending it down between an outside casing and a more interior casing, which comprises a conduit of a working fluid boring device, 188, to where ground is to be thawed. As the heated fluid flows downward some of its heat radiates out through the outside casing to the surrounding ground, warming it. A second motor drives a shaft turning a stirring fixture at the bottom of a working-fluid boring device formed by the two casings. Common director valves route fluid away from the regular engine radiator and through a radiator inside a working-fluid tank, 206. The work heated hydraulic fluid from the hydraulic pump, 203, is routed through another radiator in the same working-fluid tank. Another hydraulic motor drives another pump which pulls now cooled silt and mud laden working-fluid up from the low end of a more inside conduit formed by an inside casing and a stirring fixture drive shaft of the working-fluid boring device and feeds it back into the working-fluid tank, 206. A cross bottom rotary valve, see FIG. 15, driven by a hydraulic motor removes the mud and silt accumulating at the bottom of the working-fluid tank. The rotary valve and its casing are removed to completely access the working-fluid tank. Also shown is an enclosed engine exhaust manifold, 200, to route the hot exhaust gases to an insulated casing where heat in the exhaust gases is transferred to the engine fluid which is routed through the working-fluid tank. In addition, the working-fluid boring device, 188, its motor, 186, and its guide rack, with its ground pegs, 191, in a down position, are folded out from the top of the trailer to their operating positions with the working-fluid boring device guide rail held in position by a brace, 194.

Also shown is a pile of silt and mud, 199, dropped out from the working-fluid tank by the rotary valve.

Figure 6:
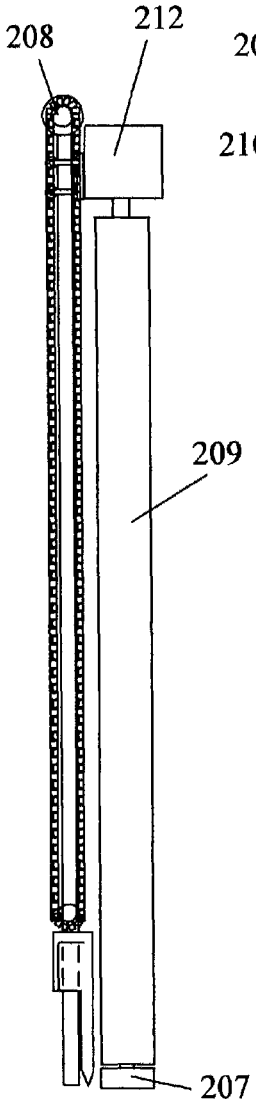
FIG. 6 is a side view of a guide rail with a motor, motor platform, chain drive motor and ground pegs with steady steps.

FIG. 6 is a side view of a guide rail and working-fluid boring device, 209, showing a motor driven chain drive, 208, attached to a platform on which is mounted a hydraulic motor, 212, driving a shaft to rotate a stirring fixture, 207.

Figure 7:
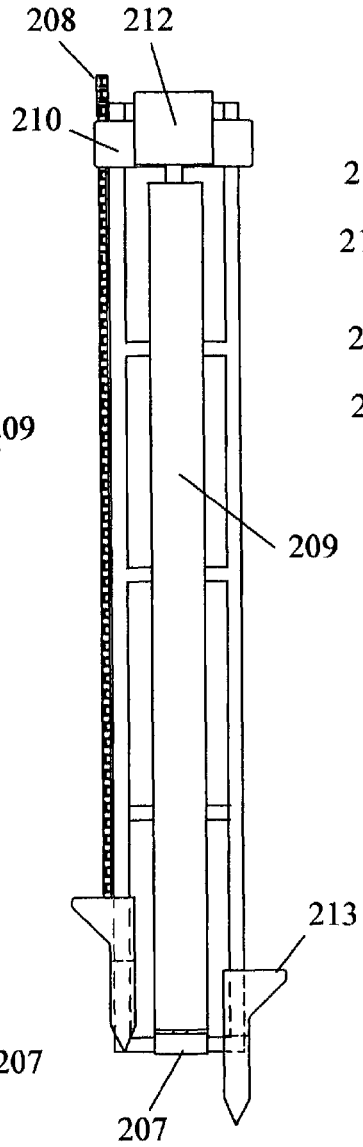
FIG. 7 is a front view of a guide rail with a motor, motor platform, chain drive motor and ground pegs with steady steps.

FIG. 7 is a front view of a guide rail rack showing a platform, 210, on which is mounted a hydraulic motor, 212, rotating a shaft, not visible, which turns a stirring fixture, 207, at the end of a working-fluid boring device, 209. The platform, 210, is moved by a chain drive, 208. A ground peg, 213, is pressed into the ground to help hold the guide rail rack in place.

Figure 8:
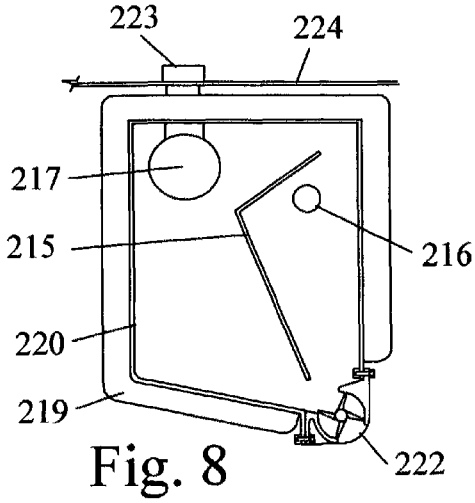
FIG. 8 is a cut away side view of a main fluid tank with a baffle, a sloped bottom, a clean out door and rotary valve and a fluid pickup and filter.

FIG. 8 is a cutaway view of an insulated, 219, working-fluid tank, 220, showing a baffle, 215, a working-fluid return, 216, a working-fluid pick up tube with a filter, 217, a fluid fill, 223, an enclosure, 224, of the apparatus and a rotary valve, 222, for mud and silt removal.

Figure 9:
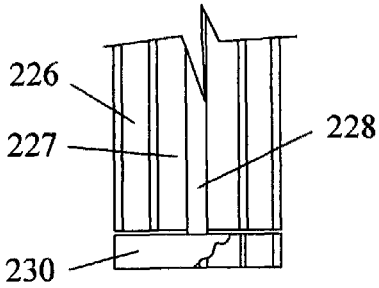
FIG. 9 is a side view of the lower portion of a working-fluid boring device showing a shaft, a stirring fixture, an inside casing and an outside casing, forming working-fluid conduits.

FIG. 9 is a cut away side view of the lower end of a working-fluid boring device, showing an outside conduit, 226, formed by an outside casing and a more interior casing, an inside conduit, 227, formed by an inside casing and a stirring fixture shaft, 228, and a stirring fixture, 230.

Figure 10:
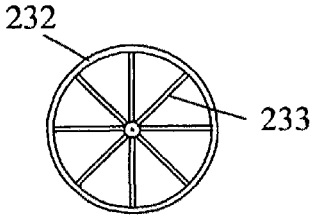
FIG. 10 is a view of a stirring fixture looking up from below.

FIG. 10 is a view of a stirring fixture, looking up from the bottom, showing its outside ring, 232, and a spoke paddle, 233.

Figure 11:
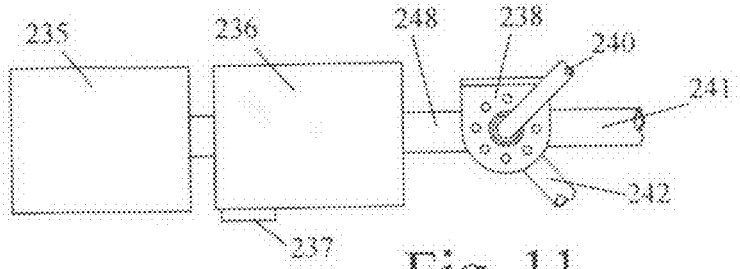
FIG. 11 is a view of a working-fluid pick up inside a working-fluid tank, showing its chambered swiveling arm for working-fluid and make up fluid, a filter, a pickup and a float.
Figure 12:
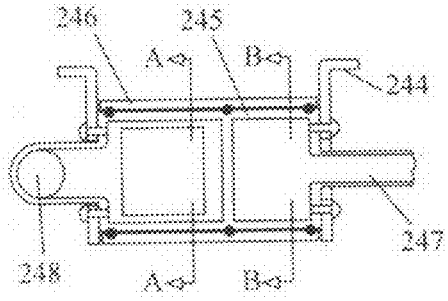
FIG. 12 is a cut-away cross section of a rotatable chambered working-fluid pickup and make up fluid distributor.

FIG. 11 is a side view of a working-fluid float, 235, filter, 236, with a working-fluid pickup, 237, a working-fluid pipe, 248, a fluid distributor, 238, see FIG. 12, a fluid fill pipe, 240, a make-up fluid pipe, 242, a working-fluid outlet pipe, 241, which is all fitted inside of a working-fluid tank.

FIG. 12 is a cut away view of a fluid distributor, see item 238, FIG. 11, showing a mounting, 244, for the inside of a working-fluid tank, a fixed circular outside casing, 246, a rotatable circular inside member, 245, a make-up fluid inlet, 247, and a working-fluid pick-up tube, 248.

Figure 13:
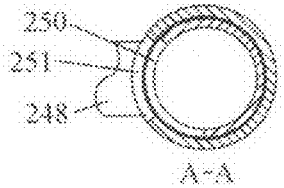
FIG. 13 is a cut-away cross section, A-A, of FIG. 12.

FIG. 13 is a cross section of a working-fluid chamber as that shown as A-A in FIG. 12, with a working-fluid pick-up tube, 248, which, by its attachment to a float, 235 in FIG. 11, is made to pivot and rotate the circular inside member, 245 in FIG. 12, up and down, causing the outside hole, 251, and the inside hole 250, to align and allow passage of working-fluid picked up from the working-fluid tank.

Figure 14:
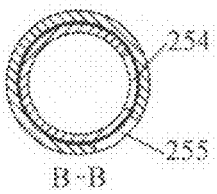
FIG. 14 is a cut-away cross section, B-B, of FIG. 12.

FIG. 14 is a cross section of a make-up fluid chamber as that shown as B-B in FIG. 12, where make-up fluid in the central chamber, by way of the make-up fluid inlet, 247 of FIG. 12, is delivered to the working-fluid tank by alignment of a hole, 255, in the fixed circular outside casing, 246, FIG. 12, and a hole, 254, in a circular inside member, 245 in FIG. 12.

Figure 15:
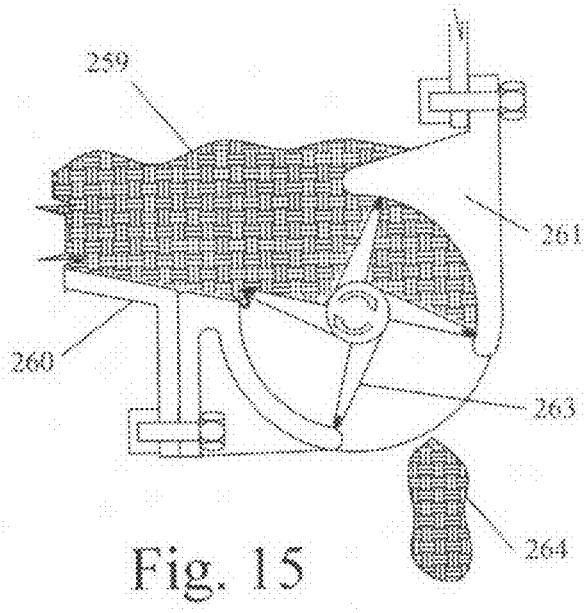
FIG. 15 is a cut-away cross section through a rotary valve attached across the lowest point of a working-fluid tank, to evacuate mud and silt.

FIG. 15 is a cross section showing the workings of a rotary valve, 263, moving clockwise within a housing, 261, attached to a working-fluid tank, 260, for the purpose of moving silted fluid and mud, 259, overboard. 264.

I claim:

1. A ground thawing and boring-with-fluid apparatus consisting of:

a. a first heat exchanger transferring heat from a cooling system of a fuel burning engine to a working-fluid to be used to thaw and bore a hole in frozen ground;

b. a second heat exchanger transferring heat from an exhaust system of the fuel burning engine to the working-fluid to be used to thaw and bore the hole in frozen ground;

c. a third heat exchanger transferring heat from a hydraulic power system to the working-fluid to be used to thaw and bore the hole in frozen ground;

d. a first device to variably restrict the hydraulic system to increase pressure and produce additional heat in the hydraulic system;

e. a second device to increase work load on the fuel burning engine to produce additional heat in the cooling system of the engine;

f. a first tubular member containing a first conduit down which the working-fluid can be moved;

g. a second tubular member containing a second conduit up which the working-fluid can be moved;

h. a shaft having a rotatable stirring head at its lower end;

at least one first motor and pump to move the working-fluid from a fluid containment tank down the first conduit;

at least one second motor and pump to move the working-fluid up the second conduit to the fluid containment tank;

the rotatable stirring head being located near the outlet of the first conduit down which the working-fluid is pumped.

* * * * *